US007404546B2

(12) United States Patent
Prager et al.

(10) Patent No.: US 7,404,546 B2
(45) Date of Patent: Jul. 29, 2008

(54) CARBURETOR ARRANGEMENT

(75) Inventors: André Prager, Waiblingen (DE); Thomas Sonnenkalb, Rudersberg (DE)

(73) Assignee: Andreas Stihl AG & Co. KG (DE)

( * ) Notice: Subject to any disclaimer, the term of this patent is extended or adjusted under 35 U.S.C. 154(b) by 240 days.

(21) Appl. No.: 11/322,082

(22) Filed: Dec. 29, 2005

(65) Prior Publication Data

US 2006/0138684 A1 Jun. 29, 2006

(30) Foreign Application Priority Data

Dec. 29, 2004 (DE) ..... 10 2004 063 197

(51) Int. Cl.
*F02M 1/02* (2006.01)

(52) U.S. Cl. ..... 261/52; 261/64.6

(58) Field of Classification Search ..... 261/52, 261/64.1, 64.6

See application file for complete search history.

(56) References Cited

U.S. PATENT DOCUMENTS 2,982,275 A * 5/1961 Doman et al. ..... 123/198 DC
3,720,403 A * 3/1973 Winquist et al. ..... 261/50.2
3,886,241 A * 5/1975 Schubeck ..... 261/39.3
4,120,274 A * 10/1978 De Lancey ..... 123/452
4,307,042 A * 12/1981 Berich ..... 261/52
4,788,014 A * 11/1988 Kanno ..... 261/39.2
4,961,409 A * 10/1990 Kobayashi et al. ..... 123/376
4,983,330 A * 1/1991 Harbeke ..... 261/52
5,200,118 A * 4/1993 Hermle ..... 261/64.6
5,215,049 A * 6/1993 Wolf ..... 123/179.18
5,611,312 A * 3/1997 Swanson et al. ..... 123/436
5,693,264 A * 12/1997 Fricke ..... 261/64.6
6,000,683 A * 12/1999 Van Allen ..... 261/52
6,202,989 B1 * 3/2001 Pattullo ..... 261/52
6,550,749 B2 * 4/2003 Vick ..... 261/52
6,641,118 B2 * 11/2003 Schliemann ..... 261/52
6,896,245 B2 * 5/2005 Suzuki et al. ..... 261/23.2
2003/0075132 A1 * 4/2003 Ohsawa et al. ..... 123/179.18

FOREIGN PATENT DOCUMENTS

JP 52-52043 * 4/1977 ..... 261/52

* cited by examiner

*Primary Examiner*—Richard L Chiesa
(74) *Attorney, Agent, or Firm*—Robert W. Becker; Robert W. Becker & Associates

(57) ABSTRACT

A carburetor arrangement for a manually-guided implement operated by an internal combustion engine. A carburetor supplies a fuel/air mixture to the engine, with a butterfly valve being disposed in the intake duct of the carburetor and with a choke valve being disposed upstream of the butterfly valve. A start lever is provided for actuating the carburetor in a start phase, and acts upon the choke valve. The start lever can be shifted in a direction of actuation and in an unlocking direction that is independent of the direction of actuation. The start lever can be locked in a rest position relative to the direction of actuation, and after being shifted out of the rest position in the unlocking direction is shiftable in the direction of actuation.

19 Claims, 6 Drawing Sheets

*Fig. 11*
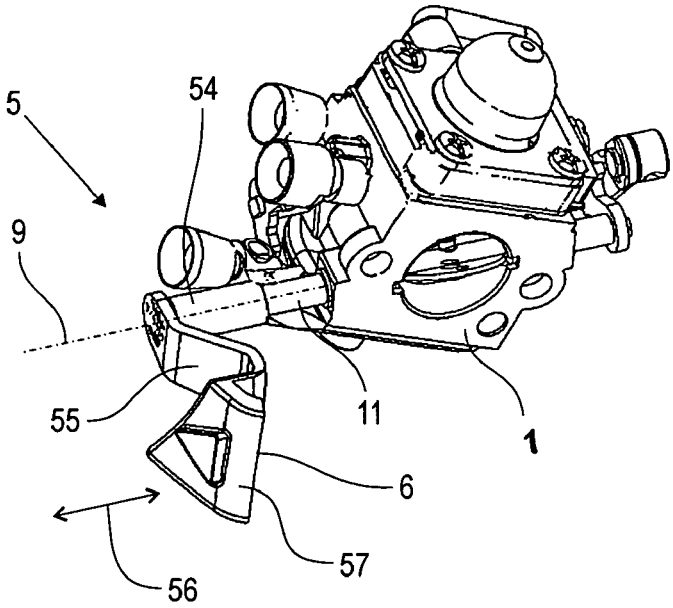
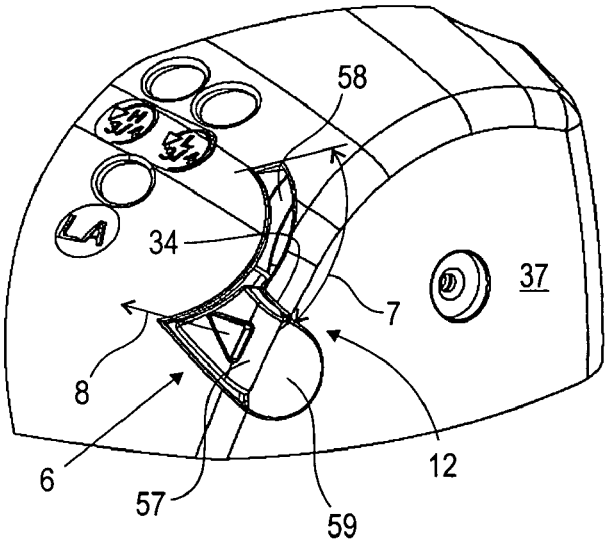
*Fig. 12*
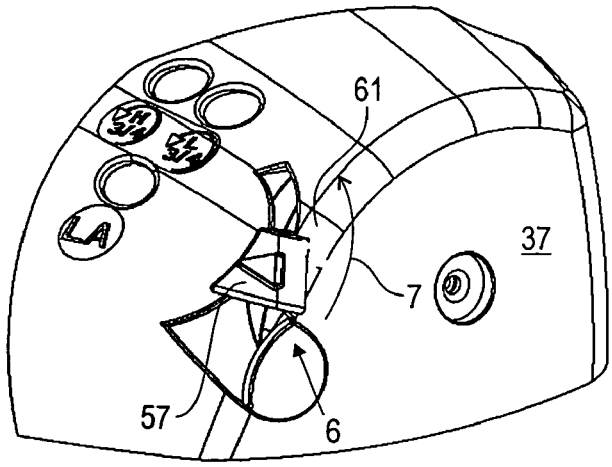
*Fig. 13*

CARBURETOR ARRANGEMENT

The instant application should be granted the priority date of 29 Dec. 2004, the filing date of the corresponding German patent application 10 2004 063 197.2.

BACKGROUND OF THE INVENTION

The present invention relates to a carburetor arrangement for a manually guided implement, especially a brushcutter, a chain saw, or the like, that is operated by an internal combustion engine.

With an implement having an internal combustion engine for a drive motor, a carburetor is provided that supplies a fuel/air mixture to the internal combustion engine. For an optimum engine performance, and to fulfill emission regulations, the carburetor is set for warm engine operation. A butterfly valve that is pivotably mounted in the intake duct of the carburetor serves for controlling the power. The pivot range extends from the fully opened state for full throttle operation to a nearly completely closed state in which the internal combustion engine is idling.

The basic setting of the carburetor is suitable for the start of the internal combustion engine only to a limited extent. When starting a cold internal combustion engine, an enrichment of the fuel/air mixture is necessary, for which a starter valve, also known as a choke valve, is provided upstream of the butterfly valve. When the choke valve is closed at least partially, the underpressure in the carburetor, and hence the quantity of fuel drawn in, increase, thereby bringing about the desired enrichment. For a reliable start, at the same time a position of the butterfly valve is necessary that is open by an additional amount relative to the idling position. For a warm start, a similar position of the butterfly valve can be expedient, whereby a closing of the choke valve is not necessary. Depending upon the various operating conditions, different relative settings of the butterfly valve and of the choke valve are necessary for the start of the internal combustion engine.

An unintentional actuation of a start lever that acts upon the choke valve can lead to increased exhaust gas emissions. Incorrect settings of the valve arrangement can also make starting difficult. The butterfly valve, when opened beyond the idling position, after start-up generates an increased initial speed, which is disadvantageous when using a centrifugal clutch.

It is an object of the present application to improve the carburetor arrangement of the aforementioned type for a manually-guided implement that is operated by an internal combustion engine such that a reliable start is achieved.

BRIEF DESCRIPTION OF THE DRAWINGS

This object, and other objects and advantages of the present invention, will appear more clearly from the following specification in conjunction with the accompanying schematic drawings, in which:

FIG. 11 shows a further variation of a single-lever arrangement with an elastically resilient start lever that is disposed directly on the choke valve shaft;

FIG. 12 is a view of the carburetor cover with the elastically resilient start lever locked therein; and FIG. 13 shows the arrangement of FIG. 12 with the start lever in an elastically resiliently raised and partially pivoted position.

SUMMARY OF THE INVENTION

Figure 1:
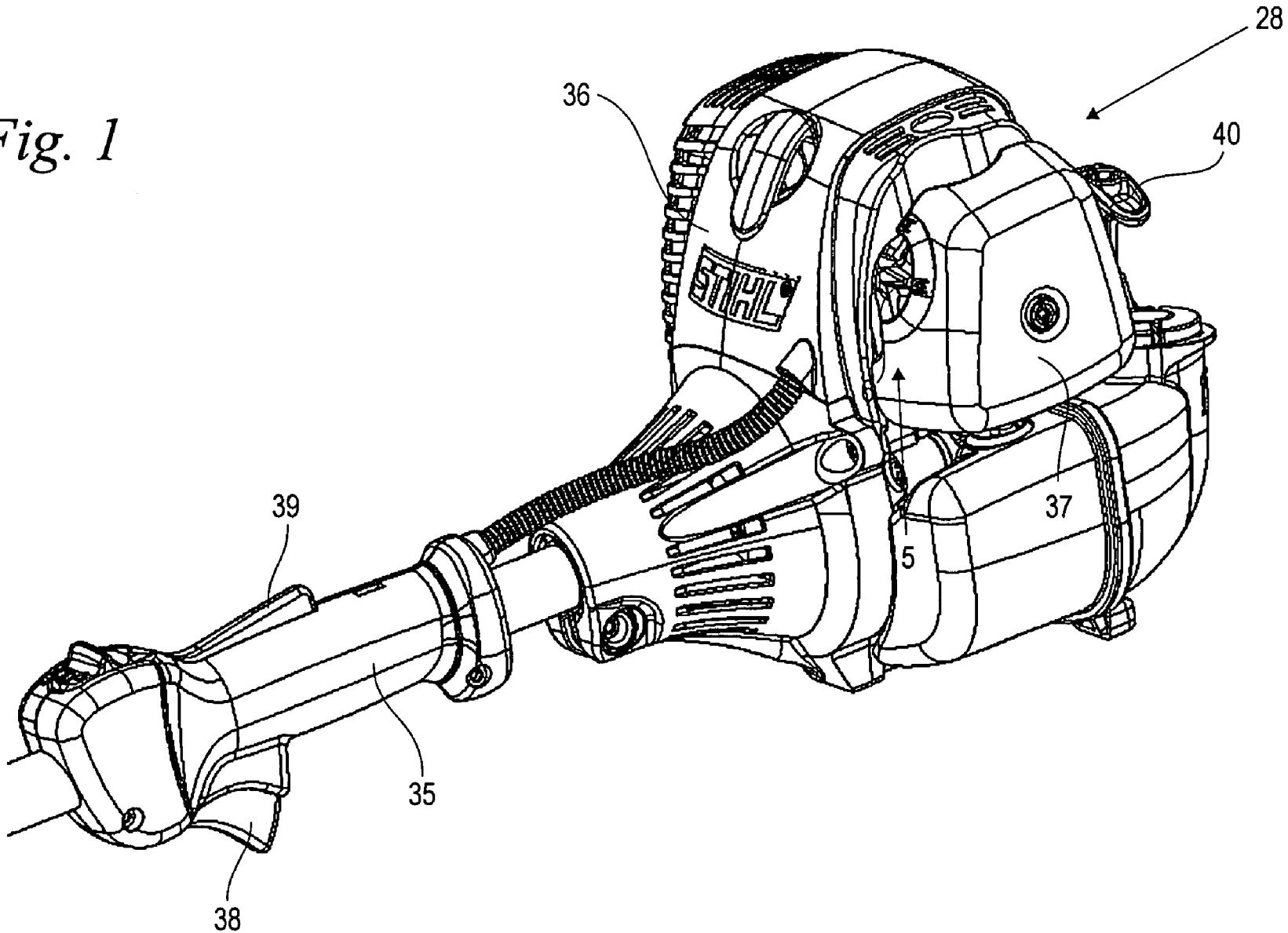
FIG. 1 is a perspective overall illustration of the region of the engine housing of a manually-guided implement, by way of example a brushcutter, with a pivotable start lever disposed in the carburetor cover.

The carburetor arrangement of the present application is provided with a start lever that acts upon the choke valve for actuation of the carburetor in the start phase. The start lever can be shifted in a direction of actuation and in an unlocking direction that extends independently of the direction of actuation. The start lever is locked in a rest position relative to its direction of actuation. After shifting the start lever out if its rest position in the unlocking direction, the start lever is unlocked such that it is shiftable in the direction of actuation.

The independence of the unlocking direction from the direction of actuation means that in the mechanical sense two directions are provided in different degrees of freedom that are independent of one another. These two directions comprise two lateral displacement directions that are disposed at least approximately perpendicular to one another and/or rotational or pivotable movements about two axes that are disposed at least approximately perpendicular to one another, whereby combinations of lateral and pivotal movements can also be expedient.

The start lever is locked in its rest position, thereby preventing an accidental actuation and setting of the choke valve and the accompanying increased exhaust gas emissions. With a butterfly valve coupled to the position of the choke valve, an increased start speed is also prevented. Prior to actuation of the valve arrangement, an unlocking movement of the start lever is first necessary. A prerequisite for the unlocking direction of the start lever that is independent of the direction of actuation is an intentional unlocking process that is followed by a similarly intentional actuation for setting the carburetor in a start configuration, which actuation follows in a different and independent direction of actuation. An accidental actuation of the valve arrangement is prevented by the locking. An accidental unlocking, due to the different direction of movement, still does not lead to an adjustment of the choke valve and/or the butterfly valve. Thus, a high degree of protection against incorrect operation is provided.

The present invention is particularly advantageous where the carburetor is embodied with a single-lever arrangement.

In such a case a single choke valve acts not only upon the butterfly valve but also upon the choke valve. The user must merely successively carry out the unlocking movement and subsequently, in a different direction, the actuation movement of the start lever. By means of a suitable kinematic, the butterfly valve and the choke valve are pivoted or shifted relative to one another in structurally provided relative positions. These positions can be optimized as a function of the position of the start lever for cold start and also for warm start. The user merely has to shift the start lever after unlocking into the respective positions provided for the cold or warm start. Unsuitable relative positions of the choke valve and of the butterfly valve are prevented. A valve setting of the carburetor arrangement that is suitable for a reliable start of the internal combustion engine can be established with little effort while avoiding incorrect operations. The reliability of the starting process of the internal combustion engine is improved accompanied by an increased operator comfort.

Pursuant to an expedient further development, a transmission mechanism between the choke valve and the butterfly valve is embodied in such a way that it automatically uncouples upon independent actuation of the butterfly valve. By means of the start lever, the choke valve is first shifted into the desired start position, whereby the transmission mechanism also carries out a corresponding setting of the butterfly valve. After the internal combustion engine has started, the user, by actuating the independent throttle trigger, which acts exclusively upon the butterfly valve, can bring about a smooth running of the engine. The independent actuation of the separate throttle trigger, i.e. the butterfly valve, effects an uncoupling of the operative connection between the choke valve and the butterfly valve. A spring biasing of the choke valve in its open direction effects an automatic resetting of the choke valve in the open operating position. In conjunction with a single-lever and locking arrangement that is disengaged from the housing, the start lever is also automatically reset to its rest position. A manual resetting is eliminated. The operational comfort and reliability are further increased.

Pursuant to an advantageous embodiment, the operative connection of the start lever to the choke valve and to the butterfly valve is interrupted in its locked rest position and is established in its unlocked position. The interruption of the operative connection of the choke valve to the valve arrangement in the locked rest position contributes to the operational reliability. To the extent that, for example as a consequence of damage, an undesired actuation of the locked start lever should occur, this cannot be transferred to the valve arrangement. For this purpose, first an active coupling of the start lever to the valve arrangement is necessary by actuation thereof in the direction of actuation.

Pursuant to an expedient further development, the start lever is a pivot lever that is pivotable about a pivot axis in its direction of actuation, whereby the unlocking direction extends in the direction of the pivot axis. Provided in particular is an unlocking direction of the start lever that corresponds to an axial pressure upon the start lever. The axial, and in particular pressing, unlocking movement can be easily brought about with little exertion of force. A subsequent pivot movement that is effected transverse thereto permits the sensitive setting of the valve arrangement in the desired cold or warm start positions as well as possibly intermediate positions.

Pursuant to an expedient embodiment, the start lever is mounted directly upon a valve shaft, and in particular upon a choke valve shaft of the carburetor. While eliminating a transmission linkage that suffers from play and elasticity, an exact valve position is simplified.

Pursuant to an expedient further development, a locking mechanism for the start lever is secured directly to the carburetor. In conjunction with the direct mounting upon the valve shaft, the arrangement is uncoupled from housing components or the like. Relative deformations of housing and engine or carburetor unit have no influence upon the selected or desired carburetor setting.

The locking mechanism advantageously includes a locking sleeve in which the start lever is guided so as to be rotatable and axially displaceable, whereby a nose that projects radially on the shaft of the start lever is guided in an arrangement comprised of a longitudinal groove, which is closed at one end, and a peripheral guide means of the locking means that proceeds from an open end of the longitudinal groove. A mechanism results that is comparable to that of a ball-point pen. The longitudinal groove permits the start lever to be pressed in axially, whereby the pivoting actuation movement of the start lever is provided only after the nose of the shaft exits the open end of the longitudinal groove and can be moved in the pivoting direction on the peripheral guide means that adjoin the longitudinal groove.

The closed design of the longitudinal groove in the opposite direction serves to prevent the start lever from becoming detached. The aforementioned arrangement provides a high precision of guidance with little sensitivity to dirt, and produces a clean separation of the unlocking movement and the actuating movement of the start lever.

In the aforementioned arrangement, the start lever is preferably guided in a longitudinally displaceable manner in the direction of its pivot axis against the pretensioning force of its spring. The spring presses the start lever, with its nose, into the closed end of the longitudinal groove, where the start lever is reliably held in its rest position. To actuate the start lever, an unlocking process that actively overcomes the pretensioning force is required, thus contributing to the operational reliability of the arrangement.

The start lever is preferably guided in an axially displaceable manner relative to a transmission shaft, whereby an end face of the transmission shaft is provided with a lateral flattened portion and engages in a receiving bore of the start lever having a shaped recess provided for positively receiving the flattened portion. The transmission shaft can in particular be one of the two valve shafts of the carburetor. The guidance thereof in the receiving bore of the start lever effects a precise relative positioning. When the start lever is axially pressed in, it glides along the transmission shaft in the axial direction until the lateral flattened portion of the shaft engages in the corresponding shaped recess on the inside of the start lever. Only then is a positive rotational connection established between the start lever and the transmission shaft, which enables an actuation of the valve arrangement. A precise, wear-resistant interlocking can be achieved in conjunction with the axial guidance in the receiving bore.

Pursuant to an advantageous further development, the axial dimension of the flattened portion and of the shaped recess correspond approximately to the axial dimension of the longitudinal groove that is closed off at one end. The axial length of the longitudinal groove prescribes the unlocking path. The aforementioned arrangement ensures that the operative connection between the start lever and the transmission shaft is interrupted in the rest position, while at the same time, after overcoming the axial unlocking path, the interlocking between the two components is precisely defined and completely established.

Pursuant to an advantageous further development, the locking sleeve has a continuous assembly groove, which extends in the axial direction, for the nose of the start lever.

The end edge of the assembly groove that is disposed remote from an end of the locking sleeve is disposed deeper than the locking sleeve, relative to the unlocking direction, than is the arrangement comprised of the longitudinal groove and peripheral guide means. During preassembly, the start lever can be inserted into the locking sleeve by guiding the nose through the continuous assembly groove. Subsequently, a rotation and a slight pulling of the start lever is effected, during which the nose is guided past below the end edge of the assembly groove and is pulled into the arrangement comprised of the longitudinal groove and the peripheral guide means. In this preassembled state the described structural unit can be mounted on the carburetor, whereby the appropriate carburetor shaft is introduced into the shaft of the start lever. The introduced valve shaft limits the axial movability of the start lever in its unlocking path. A further axial displacement of the nose to the end edge of the assembly groove is no longer possible. The start lever cannot be removed from the locking sleeve. For disassembly, it is necessary to completely dismantle the unit comprised of the locking sleeve and the start lever. A reliable protection against loss and manipulation is provided.

Pursuant to an advantageous variation, the start lever is lowered into the configuration of a housing of the implement, whereby a switch lever is provided that can be pivoted or lifted from the start lever out of the housing contour. Here, the locking of the start lever is provided in that the lowering into the housing contour prevents an accidental actuation. For the actuation, the unlocking is to be actively undertaken such that a switch lever is to be pivoted out in a pivoting movement that is independent of the direction of actuation. The configuration of the aforementioned arrangement is structurally straightforward and economical as well as resistant to wear, and is not sensitive to dirt or other influences.

With the aforementioned arrangement, the switch lever is advantageously spring biased in the direction of its lowered position. For this purpose, the switch lever is in particular made of polymeric material having a monolithically formed spring. After actuation of the start lever, the switch lever automatically pivots back into its lowered position, thus further increasing the protection against incorrect operation.

The switch lever is advantageously embodied as a switch rocker that is in particular snapped into a main body of the switch lever. The rocker, which in both directions projects beyond its pivot axis, simplifies the actuation in that in addition to raising one of the two ends of the rocker, it is also possible to press the opposite end of the rocker in.

Pursuant to an expedient variation, the locking mechanism for the throttle trigger is disposed on the housing of the implement, and is in particular formed by an edge of the housing. The start lever is advantageously elastically resilient in the direction of the pivot axis, and in its rest position is disposed relative to the housing in such a way that the aforementioned housing edge prevents a pivoting or actuation of the start lever. For actuation, the start lever must first be raised beyond the housing edge against its elastic spring force. Subsequently, the direction of actuation that is disposed transverse thereto is released. The arrangement is economical and has a structurally straightforward configuration, is resistant to wear, and is not sensitive to dirt and other external influences.

Further specific features of the present application will be described in detail subsequently.

DESCRIPTION OF SPECIFIC EMBODIMENTS

Referring now to the drawings in detail, the perspective overall illustration of FIG. 1 shows the engine region of a manually-guided implement, by way of example a brushcutter. A chain saw, a suction/blower device, a cut-off machine or the like can also be provided. A housing 28 is provided that in the illustrated embodiment includes an engine housing 36 and a carburetor cover 37. Disposed in the engine housing 36 is a non-illustrated internal combustion engine that is provided for driving a non-illustrated cutting tool of the implement. A handle 35 formed on the engine housing 36 carries a throttle trigger 38 for controlling the power of the internal combustion engine, and on the opposite side the handle 35 carries a throttle trigger lock 39. When the handle 35 is grasped with a hand, the lock 39 is pressed, thereby releasing the throttle trigger 38. During normal_operation of the implement, the throttle trigger 38 can actuate a carburetor 1, which is covered by the carburetor cover 37 and is shown in greater detail in FIG. 3. for setting the desired operational power.

To start the internal combustion engine, a starter pull cord 40 is provided on the back side of the housing 28. During starting of the internal combustion engine by means of the starter pull cord 40, the lock 39 and the throttle trigger 38 are not actuated. For bringing the carburetor 1 (FIG. 3) into the proper start configuration, a single-lever arrangement 5 is provided in the region of the carburetor cover 37 independently of the throttle trigger 38 and lock 39.

Figure 2:
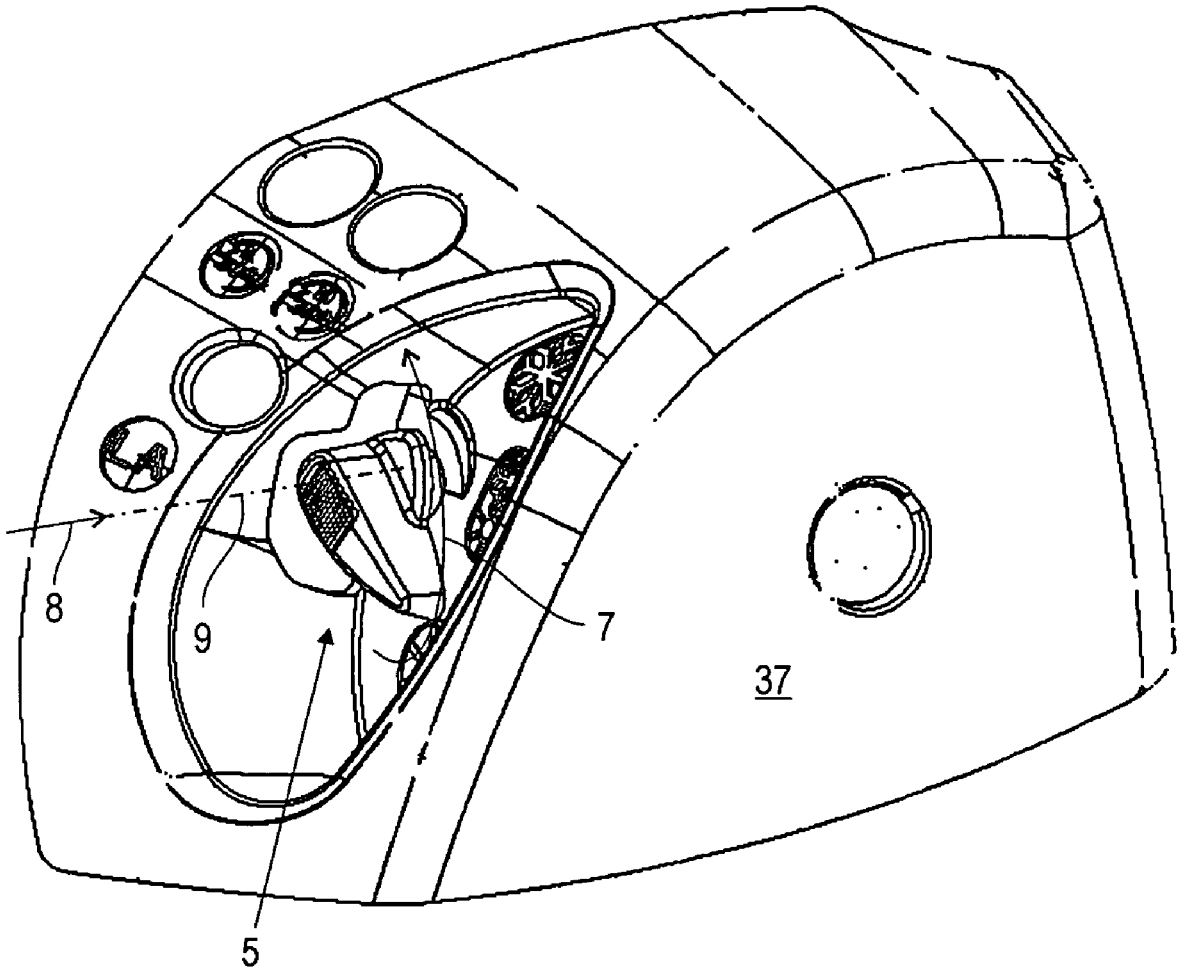
FIG. 2 is a perspective detailed view of a carburetor of the implement of FIG. 1 showing details of the start lever mounted directly on the choke valve shaft.

One embodiment of the single-lever arrangement shown in FIG. 2 includes a start lever 6, which in the illustrated embodiment is a pivot lever that is pivotable about a pivot axis 9 into a rotating direction of actuation 7. In the illustrated rest position, the start lever 6 is locked or arrested relative to its direction of actuation 7. The start lever 6 can be pressed in, in an unlocking direction 8 that extends in direction of the pivot axis 9. After being pressed in, in the unlocking direction 8, the start lever 6 can be actuated, i.e. pivoted, about its pivot axis 9 in the direction of actuation 7, whereby the carburetor 1 (FIG. 3) is brought into a start configuration. In the illustrated embodiment, the unlocking direction 8 is independent of the direction of actuation 7 such that two different directions of movement 8, 7 are required that are essentially at right angles to one another and sequentially follow one another. An alternative design may also be expedient where a linear unlocking direction 8 is followed by a linear direction of actuation 7 that is perpendicular thereto. It can also be expedient for a direction of actuation 7 that is pivotable about a pivot axis 9 to precede a pivoting unlocking direction 8, the pivot axis of which is essentially perpendicular to the pivot axis 9. Other combinations of linear and rotating movements can also be advantageous.

Figure 3:
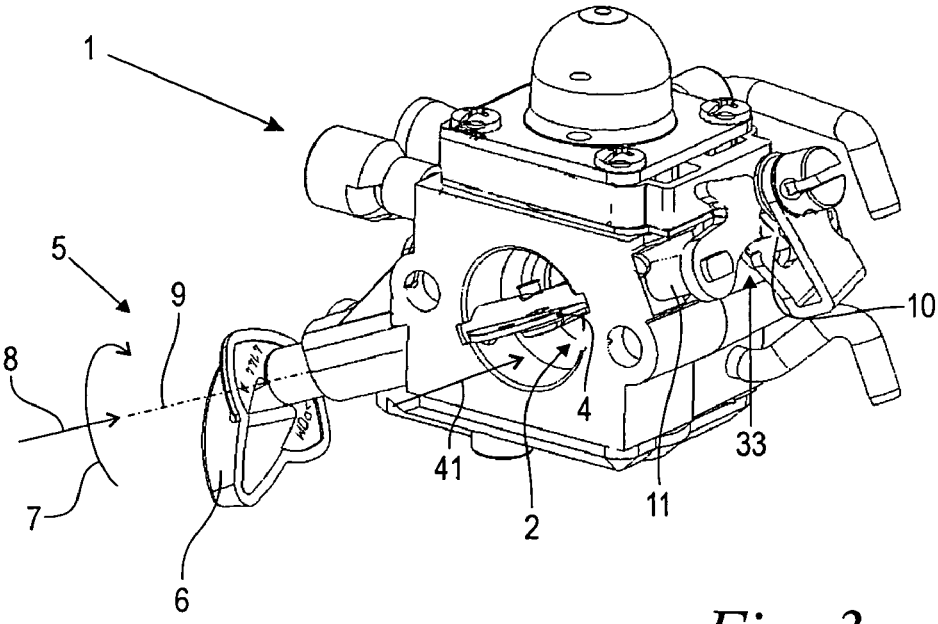
FIG. 3 is a perspective detailed view of one exemplary embodiment of a carburetor arrangement of an implement showing the details of the start lever mounted directly on the choke valve shaft.

The perspective view of FIG. 3 shows the carburetor 1 of the implement of FIG. 1, and is provided for supplying the internal combustion engine of the implement with a fuel/air mixture. For this purpose, the carburetor 1 has an intake duct 2 through which air is drawn in, in the direction of the arrow 41, and is conveyed to the internal combustion engine. Within the carburetor 1, fuel is mixed with the stream of air 41. To control the power, a butterfly valve shaft 10, on which a throttle or butterfly valve is pivotably mounted (see FIGS. 3 and 4), extends through the intake duct 2. During normal operation, the butterfly valve shaft 10 is actuated by the throttle trigger 38 (FIG. 1). The flow cross-section of the intake duct 2 can be adjusted by means of the butterfly valve 3. Provided upstream of the butterfly valve 3 (FIG. 4), in the intake duct 2, is a starter or choke valve 4 that is pivotable about a choke valve shaft 11. During a cold start, the choke valve 4 is pivoted by means of the choke valve shaft 11 into a closed position, as a result of which an increased underpressure and an enrichment of the fuel/air mixture occurs in the intake duct 2. For actuation of the choke valve 4, the start lever 6 is mounted directly on the choke valve shaft 11.

Figure 4:
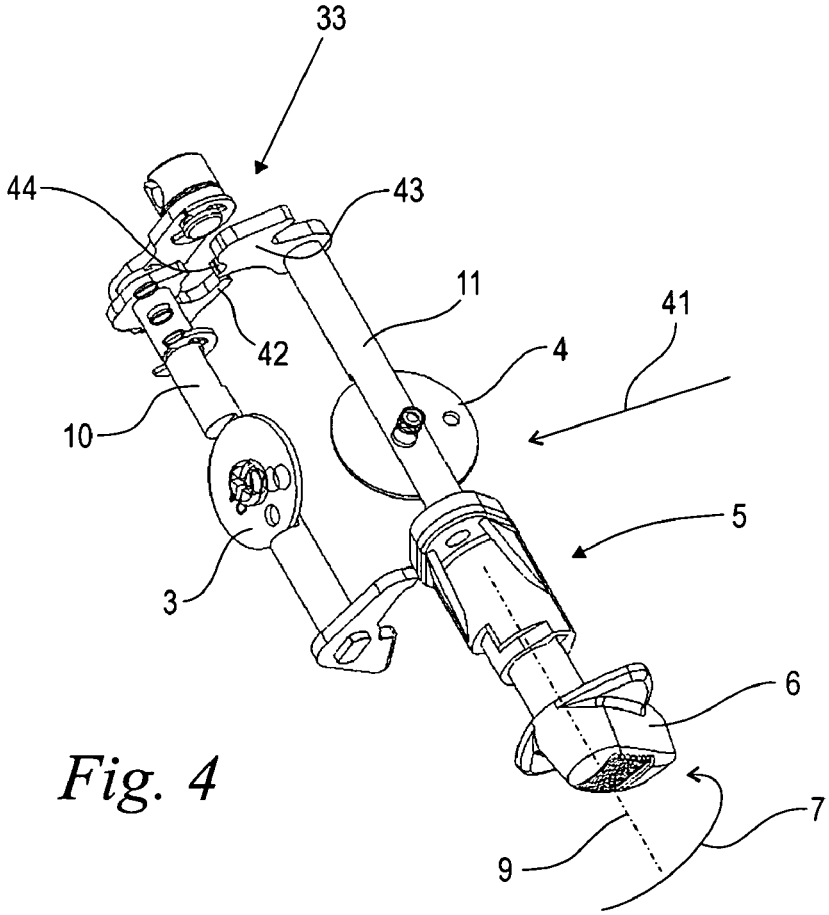
FIG. 4 is an overall view of the butterfly valve shaft and the choke valve shaft of the carburetor of FIG. 3 as connected by a transmission mechanism.

Provided between the choke valve shaft 11 and the butterfly valve shaft 10 is a transmission mechanism 33 that upon actuation of the choke valve 4 also affects the position of the butterfly valve 3 (FIG. 4). A single-lever arrangement 5 is thereby formed that when actuated acts equally upon the choke valve 4 and the butterfly valve 3. After the start lever 6 is pressed in, in the unlocking direction 8, the start lever 6 can be pivoted in the pivoting direction of actuation 7 about its pivot axis 9, whereby the choke valve 4, and to a limited extent also the butterfly valve 3 (FIG. 4), are pivoted into the position desired for starting the internal combustion engine.

The detailed view of FIG. 4 shows the choke valve shaft 11 and the butterfly valve shaft 10 that are connected by the transmission mechanism 33. The choke valve 4 is shown open relative to the direction of flow 41, while the butterfly valve 3 is pivoted essentially transverse to the direction of flow 41 and hence in its idling position. The transmission mechanism 33 includes a cam plate 43 that is connected with the choke valve shaft 11 and rests against a lever 42 of the butterfly valve shaft 10. Upon rotation of the single-lever arrangement 5 about the pivot axis 9 in the direction of actuation 7, the cam plate 43 presses upon the lever 42, as a consequence of which the butterfly valve shaft 10, together with the butterfly valve 3, is pivoted into a slightly open start position that increases the speed. In this connection, an arresting recess 44 of the cam plate 43 rests upon the lever 42, whereby the choke valve 4 is pivoted only slightly and cannot carry out its function as a choke valve for the mixture enrichment. A warm start configuration of the butterfly valve 3 and the choke valve 4 can be set. After further pivoting of the single-lever arrangement 5 in the direction of actuation 7, the choke valve 4 is pivoted into a position where it is disposed essentially transverse to the direction of flow 41, whereby due to the shape of the cam plate 43, the pivot position of the butterfly valve 3 is readjusted. A cold start configuration of the butterfly valve 3 and choke valve 4 is thereby set.

By means of respective, non-illustrated springs, the butterfly valve shaft 10 and the choke valve shaft 11 are each pretensioned in such a way that the butterfly valve 3 is biased in the direction of its closed idling position, and the choke valve 4 is biased in the direction of its opened operating position. After the internal combustion engine has been started by means of the starter pull cord 40 (FIG. 1), the speed of the internal combustion engine can be influenced by simultaneous actuation of the throttle lock 39 and the throttle trigger 38, independently of the single-lever arrangement 5 (FIG. 1), and a smooth running of the engine is effected. Upon the independent actuation of the butterfly valve 3 via the throttle trigger 38 (FIG. 1), the lever 42 is raised from the cam plate 43. The operative connection between the choke valve shaft 11 and the butterfly valve shaft 10 is uncoupled within the transmission mechanism 33. The choke valve shaft 11, together with the choke valve 4, automatically pivots under the effect of its spring pre-tension back into the illustrated open operating position. In cooperation with the choke valve shaft 11, the single-lever arrangement 5 is also brought back into the rest position.

In the illustrated embodiment, the single-lever arrangement 5 with its start lever 6 is mounted directly on the choke valve shaft 11. Another possible arrangement is where the single-lever arrangement 5 is mounted on the butterfly valve shaft 10, whereby the movement of the butterfly valve shaft 10 is transmitted via a suitable transmission mechanism 33 to the choke valve shaft 11.

Figure 5:
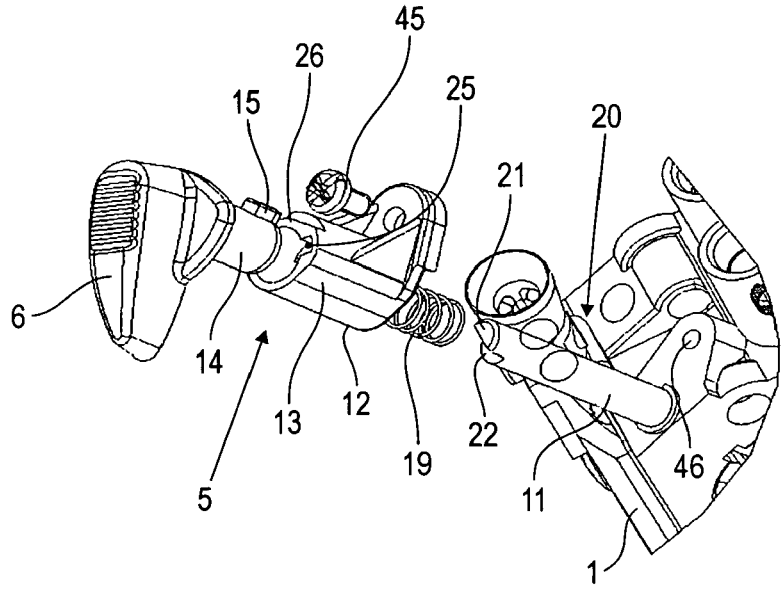
FIG. 5 is an exploded view of the single-lever arrangement with the start lever and the locking mechanism of FIGS. 1 to 4.

To further explain how the single-lever arrangement 5 of FIGS. 1 to 4 functions, an exploded view of its components is shown in FIG. 5. A locking mechanism 12 is provided that in the illustrated embodiment includes an essentially cylindrical locking sleeve 13. This locking sleeve is fastened directly onto the carburetor 1 by inserting a screw or bolt 45 through a flange of the locking sleeve 13 and screwing it into a threaded bore 46 of the carburetor 1. In this connection, the locking sleeve 13 extends about the choke valve shaft 11 as well as a compression spring 19 that is placed onto the choke valve shaft 11.

A shaft 14 of the start lever 6 carries a radially projecting nose 15. In the installed state, the shaft 14 is rotatable and to a limited extent axially shiftable in the locking sleeve 13. During assembly, the nose 15 is introduced through an open assembly groove 25 on the free end 26 of the locking sleeve 13.

Figure 6:
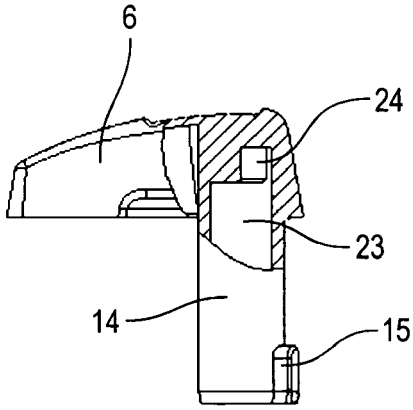
FIG. 6 is a partially cross-sectioned side view of the start lever of FIGS. 1 to 5 with details showing a receiving bore on the inside.

FIG. 6 shows a partially cross-sectioned side view of the start lever 6 of FIG. 4, with a receiving bore 23 disposed in the shaft 14. With simultaneous reference to FIGS. 5 and 6, one can see in the closed end of the receiving bore 23 in FIG. 6 a shaped recess 24, the contour of which corresponds to a lateral flattened portion 22 on the end face 21 of the choke valve shaft 11.

Figure 7:
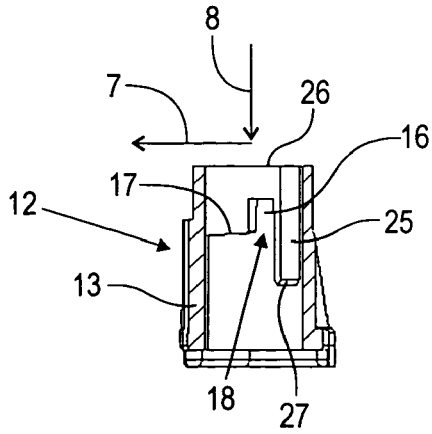
FIG. 7 is a longitudinal cross-sectional view of the locking sleeve of FIG. 5 showing details of the arrangement of a longitudinal groove and a peripheral guide means.

With additional reference to the longitudinal cross-sectional view of the locking sleeve 13 in FIG. 7, one can also see that formed in the inner wall of the locking sleeve 13 is a contour that includes the assembly groove 25, a longitudinal groove 16 as well as a peripheral guide means 17. The assembly groove 25, which is open in both radial directions and proceeds from the free end 26 of the locking sleeve 13, ends within the locking sleeve 13 in an end edge 27. From there, the inner contour merges in the opposite direction into the longitudinal groove 16, which is closed off in the direction of the free end 26 of the locking sleeve 13. At its opposite, open end 18, the longitudinal groove 16 merges, in the direction of actuation 7, into the peripheral guide means 17, which in the illustrated embodiment is a radially inwardly projecting edge that extends in the peripheral direction. A peripheral groove could also be provided.

With simultaneous reference to FIGS. 5 to 7, the assembly of the single-lever arrangement 5 is effected in that first the start lever 6 is introduced into the locking sleeve 13 in such a way that the nose 15 is inserted through the assembly groove 25. The shaft 14 is inserted into the locking sleeve 13 until the nose 15 is rotated below the end edge 27 in the direction of the arrow 7, and can again be raised counter to the unlocking direction 8. In this connection, the start lever 6 is raised to such an extent that the nose 15 lies in the longitudinal groove 16. The preassembled unit comprised of the start lever 6 and the locking sleeve 13, along with the compression spring 19, is fastened to the carburetor 1 in conformity with the illustration of FIG. 5, whereby the compression spring 19 presses the nose 15 against the closed end of the longitudinal groove 16, In the aforementioned assembled position, the single-lever arrangement 5 is in its rest position. The shaft 14 of the start lever 6 is mounted in the locking sleeve 13 so as to be axially displaceable against the compressive force of the spring 19, whereby the receiving bore 23 of the shaft 14 is additionally mounted on the choke valve shaft 11. The depth of the receiving bore 23, with the shaped recess 24 at the end, is dimensioned such that in the rest position, the flattened portion 22 of the end face 21 of the choke valve shaft 11 does not engage in the shaped recess 24. A rotating, positive operative connection between the start lever 6 and the choke valve shaft 11 is interrupted. The nose 15 that is held in the longitudinal groove 16 locks the start lever 6 in its direction of actuation 7, thereby forming the locking mechanism 12.

As a result of axial pressure on the start lever 6 in the unlocking direction 8, the start lever 6 is shifted in this direction relative to the locking sleeve 13 and to the choke valve shaft 11 until as a consequence of a pivoting movement of the start lever 6, the nose 15 can slide along the peripheral guide means 17 in the direction of actuation 7. The axial dimension of the flattened portion 22 and of the shaped recess 24 is only slightly less than the axial dimension of the longitudinal groove 16 from its closed end to its open end 18. The arrangement of the longitudinal groove 16 and of the peripheral guide 17 is coordinated with the position of the end face 21 of the choke valve shaft 11 in such a way that in the pressed-in state of the start lever 6, in which the nose 15 thereof can be guided past the peripheral guide means 17 in the pivoting direction of actuation 7, the flattened portion 22 of the choke valve shaft 11 engages entirely in the shaped recess 24 of the receiving bore 23 in the start lever 6. In the unlocked, pressed-in state of the start lever 6, a positive operative connection to the choke valve 11 in the direction of actuation 7 is established.

The choke valve shaft 11 forms a transmission shaft 20 in the direction of the butterfly valve 3 and the choke valve 4 (FIGS. 3, 4). It can also be expedient to provide a transmission shaft 20 that is separate from the butterfly valve shaft 10 or the choke valve shaft 11.

The engagement of the flattened portion 22 of the choke valve shaft 11 in the shaped recess 24 of the receiving bore 23 also effects an axial stop of the start lever 6 in the unlocking direction 8. This is dimensioned such that although the nose 15 can slide along the peripheral guide means 17, it cannot be guided beyond the end edge 17, which is disposed lower in the axial direction, and into the assembly groove 25. When the locking sleeve 13 is fastened to the carburetor 1, the start lever 6 cannot become detached.

Figure 8:
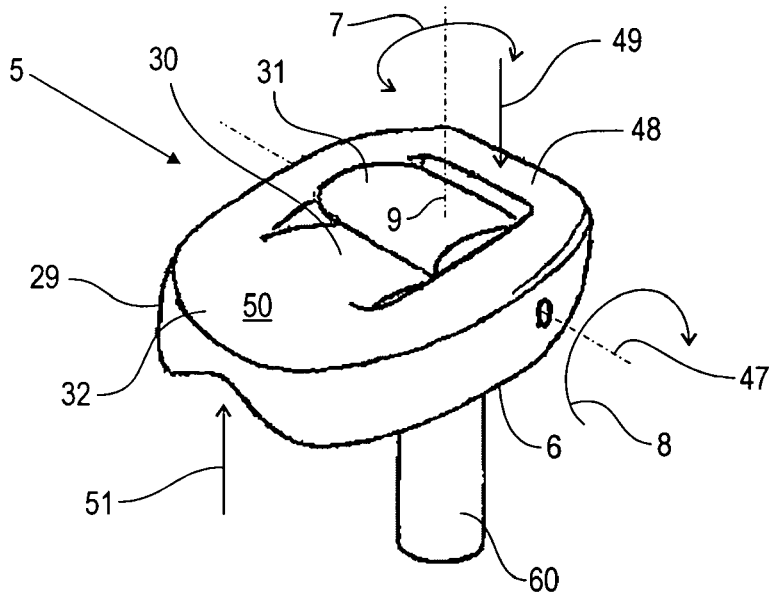
FIG. 8 shows a variation of the single-lever arrangement of FIGS. 1 to 7 with a pivotable switch lever.
Figure 9:
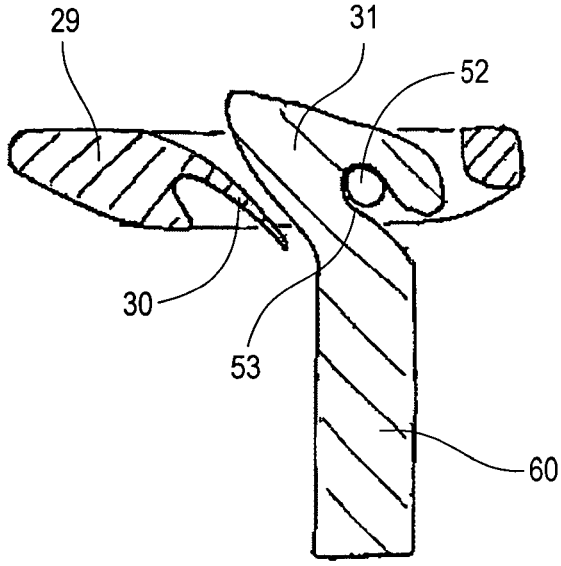
FIG. 9 is a cross-sectional view of FIG. 8 showing details of a snapped-in support and a monolithically formed spring.
Figure 10:
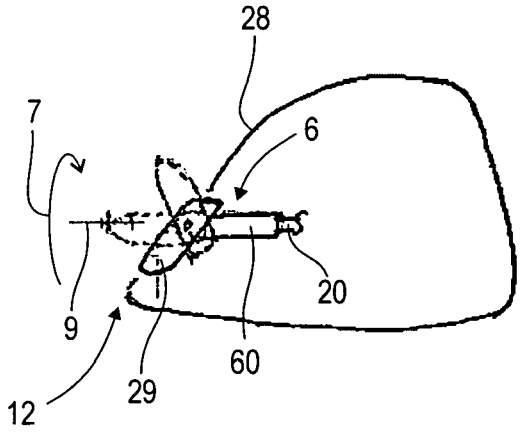
FIG. 10 is a schematic illustration of the single-lever arrangement of FIGS. 8 and 9 flushly lowered into a housing.

FIGS. 8 to 10 show a further embodiment of a single-lever arrangement 5. Pursuant to FIG. 8, the start lever 6 is comprised of a main body 31 having a shaft 60, as well as a switch lever 29. The switch lever 29 can be lifted up relative to the main body 31 about a pivot axis 47 that is disposed transverse to the pivot axis 9. The switch lever 29 is produced of injection molded polymeric material and has monolithically formed thereon a flat spring 30, which rests against the main body 31. From the illustrated position, which is disposed transverse to the pivot axis 9, the switch lever 29 can be lifted up about the pivot axis 47 against the pretension force of the spring. For this purpose, in the illustrated embodiment, the switch lever 29 is in the form of a switch rocker 32 that transverse to the pivot axis 47 extends beyond the shaft 60 in both directions. A lifting or tilting up movement can be effected either by raising the switch rocker 32 on a lifting side 50 in the direction of the arrow 51, or by pressing upon the opposite pressing side 48 in the direction of the arrow 49. The pivoting movement of the switch lever 29 about the pivot axis 47 corresponds to an unlocking movement in a pivoting unlocking direction 8 that extends independently of the direction of actuation 7 in such a way that the pivot axis 47 is disposed at least approximately perpendicular to the pivot axis 9.

FIG. 9 shows a longitudinal cross-sectional view of the arrangement of FIG. 8, according to which the main body 31 and the shaft 60 are monolithically formed of injection molded polymeric material and have a pivot support 53 formed therein. A pivot pin 52 that is monolithically formed on the switch lever 29 is snapped into the pivot support 53. The curved flat-type spring 30 rests against an inclined underside of the main body 31.

The diagrammatic sketch of FIG. 10 shows the start lever 6 relative to the housing 28, according to which the shaft 60 is placed upon the transmission shaft 20. In the illustrated rest position, which is shown in solid lines, the switch lever 29 is lowered into the contour of the housing 28 of the implement (FIG. 1), as a result of which even without direct contact of the start lever 6 with the housing 28 a locking mechanism 12 is formed. The switch lever 29 can be lifted or pivoted out of the illustrated lowered position, in the unlocking direction 8 (FIG. 8), into its actuating position, which is illustrated by dashed lines in FIG. 10, thereby providing actuation of the start lever 6 in the direction of actuation 7 as a pivoting movement about the pivot axis 9. After actuation has been effected and the switch lever 29 is released, the latter springs back under the effect of its spring 30 into the illustrated lowered rest position.

In both embodiments of FIGS. 1 to 10, there is no kinematic reciprocal action between the respective single-lever arrangement 5 and the housing 28. Rather, the respective single-lever arrangement 5, including its locking mechanism 12, is connected exclusively with the carburetor 1. The respective spring 19 or the spring 30 effects an automatic resetting of the start lever 6 counter to the unlocking direction 8. The pretension force of the choke valve 4 or the choke valve shaft 11 into the opened pivoted position effects an automatic resetting of the start lever 6 counter to the direction of actuation 7, which is followed by the previously described automatic resetting counter to the unlocking direction 8.

A further embodiment of the inventive carburetor arrangement is shown in FIGS. 11 to 13. Pursuant to FIG. 11, a start lever 6 is mounted directly on the choke valve shaft 11. In the illustrated embodiment, the start lever 6 includes a shaft 54 for the mounting on the choke valve shaft 11, a gripper handle section 57 that is disposed radially outwardly relative to the pivot axis 9, as well as a spring section 55 disposed between the shaft 54 and the grip section 57. The flat spring type spring section 55 of the start lever 6, which is monolithically produced of injection molded polymeric material, permits an elastically resilient movement of the grip section 57 in the direction indicated by the double arrow 56, which is parallel to the pivot axis 9 of the structural unit comprised of the start lever 6 and the choke valve shaft 11 in the carburetor 1.

FIG. 12 shows the carburetor arrangement of FIG. 10 covered by the carburetor cover 37, according to which the start lever 6 is guided in a curved groove 58 of the carburetor cover 37. The curved groove 58 follows a direction of actuation 7 that is prescribed by the pivot axis 9 (FIG. 11). Formed in the carburetor cover 37 is a finger recess 59 in which rests the grip section 57 of the start lever 6. In the state of rest, the grip section 57 rests against a housing edge 34 relative to the direction of actuation 7, as a result of which a locking mechanism 12 that acts in the direction of actuation 7 is formed. To unlock the start lever 6, one can grasp with one finger into the finger recess 59 and raise the grip section 57 in the direction of the arrow 56 (FIG. 11) against the spring force of the spring section 55. The appropriate raising is effected in the unlocking direction 8 until the grip section 57 is no longer held in the direction of actuation 7 by the housing edge 34.

In conformity with the illustration of FIG. 13, the start lever 6 can subsequently be pivoted by its grip section 57 out of the rest position shown in FIG. 12 in the direction of actuation 7 relative to the carburetor cover 37, whereby the grip section 57 slides over the outside 61 of the housing. Also with the embodiment illustrated in FIGS. 11 to 13 is the unlocking direction 8 a direction of movement of the start lever 6 that is independent of the direction of actuation 7.

The specification incorporates by reference the disclosure of German priority document 10 2004 063 197.2 filed 29 Dec. 2004.

The present invention is, of course, in no way restricted to the specific disclosure of the specification and drawings, but also encompasses any modifications within the scope of the appended claims.

We claim:

1. A carburetor arrangement for a manually-guided implement that is operated by an internal combustion engine, comprising:

a carburetor for supplying a fuel/air mixture to said internal combustion engine, wherein a butterfly valve is disposed in an intake duct of said carburetor for controlling engine power, and wherein upstream of said butterfly valve a choke valve is also disposed in said intake duct;

a start lever for actuating said carburetor in a start phase, wherein said start lever acts upon said choke valve, wherein said start lever is adapted to be shifted in a direction of actuation and in an unlocking direction that is independent of said direction of actuation, wherein said start lever is adapted to be locked in a rest position relative to said direction of actuation, and wherein after said star lever is shifted out of said rest position in said unlocking direction, said start lever is unlocked such that it is shiftable in said direction of actuation, and a locking mechanism for said start lever, wherein said locking mechanism is secured directly to said carburetor.

2. A carburetor arrangement according to claim 1, wherein said start lever is part of a single-lever arrangement that acts in common upon said choke valve and also upon said butterfly valve.

3. A carburetor arrangement according to claim 2, wherein a transmission mechanism is provided between said choke valve and said butterfly valve, and wherein upon an independent actuation of said butterfly valve, said transmission mechanism is adapted to automatically uncouple said choke valve from said butterfly valve.

4. A carburetor arrangement according to claim 1, wherein an operative connection of said start lever to said butterfly valve is interrupted in a locked rest position of said start lever and is established in an unlocked position of said start lever.

5. A carburetor arrangement according to claim 1, wherein said start lever is a pivot lever that is pivotable about a pivot axis in said direction of actuation, and wherein said unlocking direction extends in the direction of said pivot axis.

6. A carburetor arrangement according to claim 5, wherein said unlocking direction of said start lever corresponds to an axial pressure upon said start lever.

7. A carburetor arrangement according to claim 5, wherein said start lever is mounted directly on a valve shaft of said carburetor.

8. A carburetor arrangement according to claim 7, wherein said start lever is mounted directly on a choke valve shaft of said carburetor.

9. A carburetor arrangement according to claim 1, wherein said locking mechanism includes a locking sleeve in which said start lever is guided so as to be rotatable and axially displaceable, wherein a nose is provided that projects radially from a shaft of said start lever, and wherein said nose is guided in an arrangement comprised of a longitudinal groove, which is closed off at one end, and a peripheral guide means of said locking sleeve that proceeds from an open end of said longitudinal groove.

10. A carburetor arrangement according to claim 9, wherein said start lever is guided in a direction of a pivot axis thereof, in a longitudinally displaceable manner, against the pre-tensioning force of a spring.

11. A carburetor arrangement according to claim 9, wherein a transmission shaft is provided, wherein said start lever is axially displaceably guided relative to said transmission shaft, wherein an end face of said transmission shaft is provided with a lateral flattened portion, and wherein said end face is adapted to engage in a receiving bore of said start lever that has a shaped recess that is provided for positively receiving said flattened portion.

12. A carburetor arrangement according to claim 11, wherein an axial dimension of said flattened portion and of said shaped recess corresponds approximately to an axial dimension of said longitudinal groove.

13. A carburetor arrangement according to claim 9, wherein said locking sleeve is provided with an axially extending, continuous assembly groove for said nose of said start lever, wherein said assembly groove has an end edge that is disposed remote from a free end of said locking sleeve, and wherein said end edge is disposed deeper in said locking sleeve, relative to said unlocking direction, than is said arrangement comprised of said longitudinal groove and said peripheral guide means.

14. A carburetor arrangement according to claim 1, wherein said start lever is recessed into a contour of a housing of said implement, and wherein a switch lever is provided that is adapted to be pivoted from said start lever out of said housing contour.

15. A carburetor arrangement according to claim 14, wherein said switch lever is spring biased in the direction of a recessed position thereof.

16. A carburetor arrangement according to claim 15, wherein said switch lever is formed of a polymeric material and has a monolithically formed spring.

17. A carburetor arrangement according to claim 14, wherein said switch lever is in the form of a switch rocker that is adapted to be snapped into a main body of said start lever.

18. A carburetor arrangement according to claim 1, wherein a locking mechanism is provided for said start lever and is disposed in a housing of said implement, and wherein said locking mechanism is formed by an edge of said housing.

19. A carburetor arrangement according to claim 1, wherein said start lever is elastically resilient in a direction of a pivot axis thereof.

* * * * *